United States Patent [19]

Decrane

[11] Patent Number: 4,863,065

[45] Date of Patent: Sep. 5, 1989

[54] BULK BAG DISCHARGE UNIT AND METHOD

[76] Inventor: Charles E. Decrane, 802 Janna St., West Monroe, La. 71291

[21] Appl. No.: 248,585

[22] Filed: Sep. 26, 1988

[51] Int. Cl.[4] ..... B65D 33/14

[52] U.S. Cl. ..... 222/1; 222/105; 222/156; 222/183; 222/185; 222/203; 222/460; 222/564

[58] Field of Search ..... 222/1, 105, 130, 131, 222/156, 180, 181, 183, 185, 203, 460, 461, 547, 564; 220/403, 404; 141/114, 365; 383/41, 67, 906

[56] References Cited

U.S. PATENT DOCUMENTS

| | | | |
|---|---|---|---|
| 3,255,927 | 6/1966 | Rupert, Jr. et al. | 222/183 X |
| 3,433,400 | 3/1969 | Hawkins | 222/185 X |
| 3,789,897 | 2/1974 | Saito | 222/105 X |
| 3,961,655 | 6/1976 | Nattrass et al. | 222/181 X |
| 4,518,106 | 5/1985 | La Fleur | 222/105 X |
| 4,527,716 | 7/1985 | Haas et al. | 222/105 X |
| 4,573,204 | 2/1986 | Polett | 222/181 X |
| 4,658,989 | 4/1987 | Bonerb | 222/185 X |
| 4,669,950 | 6/1987 | St. Lawrence | 222/180 X |
| 4,759,473 | 7/1988 | Derby et al. | 222/181 X |
| 4,810,156 | 3/1989 | Pendleton et al. | 222/203 X |
| 4,817,824 | 4/1989 | La Fleur et al. | 22/185 X |

*Primary Examiner*—Kevin P. Shaver
*Attorney, Agent, or Firm*—Norvell E. Von Behren

[57] ABSTRACT

A bulk bag discharge unit having a discharge hopper with an inner liner support. The inner liner support is used to retain, in the hopper, the inner liner discharge spout and a portion of the bulk bag inner liner as the bulk bag is emptied. A plurality of splitter fingers hold the inner support in the inside of the hopper and form openings which allow bulk product to pass out of the hopper but also prevent the liner spout and a portion of the liner from passing out of the hopper. A method of preventing the dropping out of the liner during discharge using the liner support is also disclosed.

20 Claims, 3 Drawing Sheets

BULK BAG DISCHARGE UNIT AND METHOD

BACKGROUND OF THE INVENTION

This invention relates generally to bag discharge systems and more particularly to a new and novel bulk bag discharge unit having a novel hopper designed to retain the inner liner of a bulk bag during discharge.

It is known in the various industries to use large bulk bags for moving products such as pharmaceuticals, food products, toxic products, aspirin, chlorine pellets and others within a given industrial plant. The large bulk bags can weigh between 750 pounds and up to 4000 pounds and generally have an inner throwaway liner contained inside the bag. By referring to FIGS. 1–4 of the drawings there is shown generally by the numeral 10 a typical bulk bag of the type before mentioned. A plurality of lifting loops 12 are used to lift the bag 10 by using a forklift truck. A typical bag 10 may be constructed of woven polypropylene and would have an outer diameter of 42 inches with an 18 inch diameter upper filling spout 14. A tying cord 16 is used to tie the bag shut after it is filled.

The bulk bag 10 also has a lower emptying spout 18 which may be 14 inches in diameter and is tied shut by a tying cord 20. FIG. 2 shows a bottom plan view of the bag as it would appear after being filled with the tying cord tied shut and with the inner liner 22 tucked inside the bag 10 prior to being tied. A top plan view of the bag 10 would also look similar to FIG. 2 after the bag was filled with a bulk product 21. FIG. 3 shows a cross-sectional view of the bulk bag 10, taken along line 3—3 of FIG. 1 and shows how the liner 22 is positioned inside the outer bag 10.

The bag 10 may be 24–80 inches long and the inside liner 22 would be formed of a 44 inch diameter polypropylene tube in a typical size with the liner usually being 2–6 mil thick. FIG. 3 shows a bag 10 with the inner liner 22 opened as the bag may appear when it is being emptied. The inner liner 22 may extend out of the bag about 18 inches prior to its being emptied as shown by the arrow direction 23. The liner 22 also has an upper liner filling spout 24, shown in FIG. 1, as well as a lower liner discharge spout 26. Tying cords 25 are used to tie the upper liner filling spout shut after the bag has been filled and tying cords 27 are used to tie the lower discharge spout shut prior to the bag being filled. When the bag 10 is to be emptied, the bulk product 21 will empty out, in the direction of the arrow 28, of the liner into a hopper where it will be conveyed to an in-plant system by means of an auger or a pneumatic conveying system.

Referring to FIG. 4 there is shown a cross-sectional view similar to FIG. 3 showing the bag 10 being emptied and how the inner liner 22 extends out of the lower bag discharge spout 18. As the bulk product 21 flows out of the liner 22 it tends to pull the liner out of the bag as shown in FIG. 4. The liner 22 can extend out of the bag, as shown by the arrow 29, by as much as 6 feet which can cause problems in the hopper usually positioned beneath the bag 10.

The excess liner 22 which is pulled out of the bag 10, by the amount shown as the arrow 29 in FIG. 4, can interfere with the operation of the lower conveyor system or auger. In addition a discharge valve may also be used at the bottom of the hopper and the excess liner 22 can interfere with the operation of the valve.

Prior to the advent of the applicant's novel invention, in order to overcome the problem of the excess liner 22, shown in FIG. 4, interfering with the lower devices below a hopper, the bulk bag 10 was lifted by a forklift truck or hoist upwardly as the bag was emptied to compensate for the excess liner 22 extending out the bottom of the bag 10. The solution would require excessively high ceiling heights in the plant to raise the bag upwardly so that the excess liner 22 would not get into the conveyor or valve.

Since the bulk bags 10 were introduced approximately 12 years go in the United States, the inner liner 22 usage began about 6 years ago and appears likely to continue. The use of the inner liner 22 allows a multiple use of the bag 10 and permits a cleaner product with no moisture or varment contamination. As a result, the problem of what to do with the excess liner extending out of the bag 10 as it is being emptied has remained until recently solved by the applicant's new and novel device.

SUMMARY OF THE INVENTION

In order to overcome this unique problem, the applicant's solution utilizes a novel bulk bag discharge unit with a novel discharge hopper positioned beneath the bulk bag 10. The discharge hopper contains an inner liner support with an upwardly extending tube around which is positioned the lower liner discharge spout 26 prior to emptying the bag 10. The inner liner support is fixedly attached to the inside of the discharge hopper by a plurality of outwardly extending splitter fingers in the preferred embodiment. These fingers form a plurality of openings through which the bulk product may pass as well as passing through the upwardly extending tube when the bag is being emptied.

The splitter fingers also serve to retain the excess liner 22 that drops out of the bags, as shown in FIG. 4, in a reservoir area which is formed between the inner sides of the discharge hopper and the outer sides of the upwardly extending tube. As a result, the excess liner 22 can not drop past the splitter fingers and can not interfere with the conveyor below, the auger or a valve that may be used below the hopper.

Accordingly it is an object and advantage of the invention to provide a novel discharge unit with a novel discharge hopper that prevents the inner bag liner from restricting bulk product flow into internal devices at the bottom of the hopper.

Another object and advantage of the invention is to provide a novel hopper inner liner support which eliminates the use of costly "glued in" liners or shaped liners that will not be pulled out of the bulk bag as the bag is being emptied.

A further object and advantage of the invention is to provide a novel discharge unit which provides dust control and operator safety by the unit design.

Still yet another object and advantage of the invention is to provide an agitator system to agitate the bottom of the bulk bag as it sits upon the discharge unit to expedite the flow into the hopper of the bulk product.

It is another object and advantage of the invention to provide a new and novel method of preventing bag inner liners from dropping out of the bag and into an internal device beneath the discharge hopper.

These and other objects and advantages will become apparent after reviewing the drawings and reading the description of the Preferred embodiment which has been given by way of illustration only.

BRIEF DESCRIPTION OF THE DRAWINGS

In FIG. 3 the upper liner filling spout has been shown tucked into the bag filling spout with the tying cord pulled tight and securely tied. The lower liner discharge spout has been shown open.

DESCRIPTION OF THE PREFERRED EMBODIMENT

Figure 1:
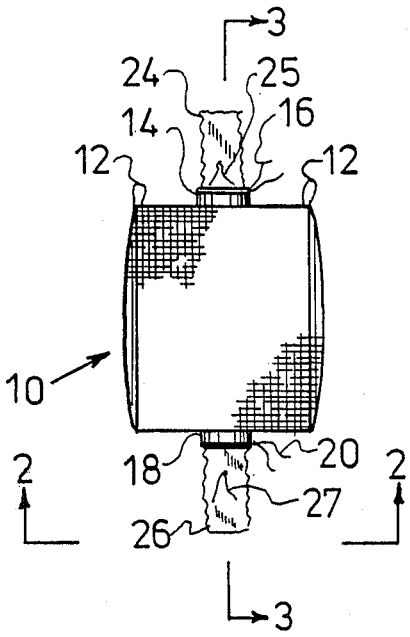
FIG-1 PRIOR ART
FIG. 1 is a side elevational view of a prior art bulk bag showing the bag filling and discharge spouts and also showing the inner bag liner and liner filling and discharge spouts.
Figure 3:
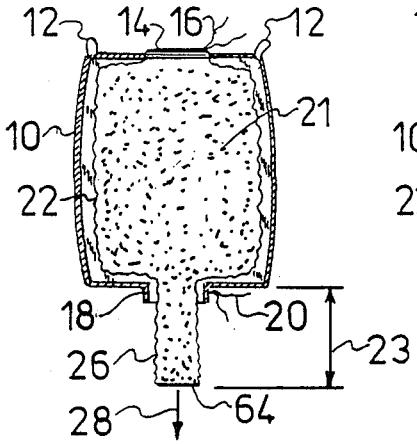
FIG-3 PRIOR ART
FIG. 3 is a cross-sectional view, taken along line 3—3 of FIG. 1 showing the inner bag liner and bulk product contained in the inner liner.
Figure 4:
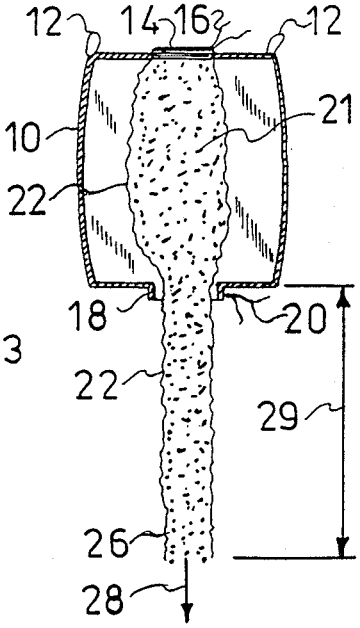
FIG-4 PRIOR ART
FIG. 4 is a cross-sectional view, taken along line 3—3 of FIG. 1 showing how the prior art bulk bag would empty and how the inner liner comes out of the bag through the bag discharge spout.
Figure 2:
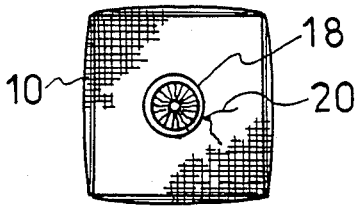
FIG-2 PRIOR ART
FIG. 2 is a bottom plan view, taken along line 2—2 of FIG. 1, of a filled bulk bag prior to being opened.
Figure 5:
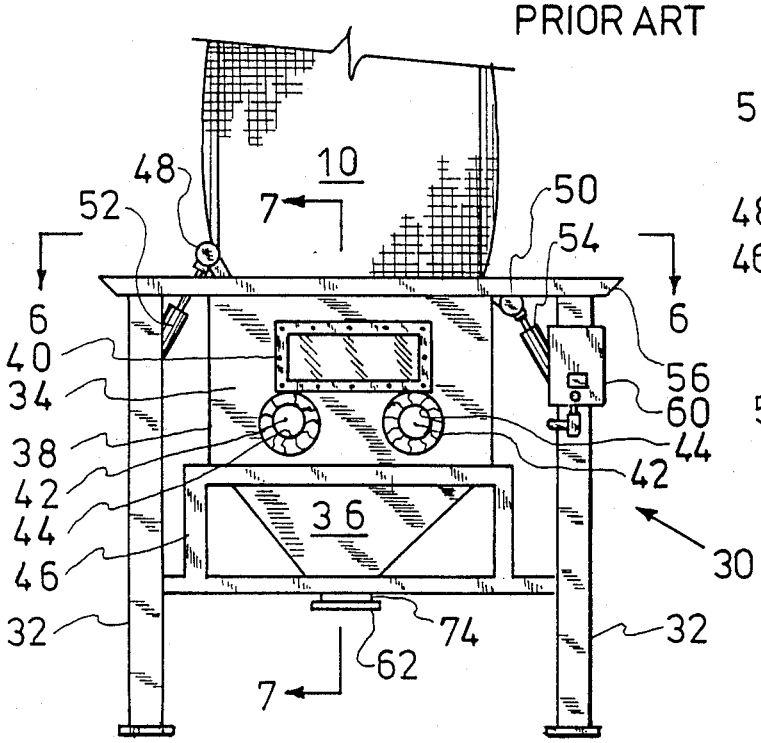
FIG. 5 is a side elevational view of the applicant's new and novel bulk bag discharge unit showing a filled bulk bag positioned on top of the unit.

Referring now to FIG. 5 of the drawing there is shown the applicant's novel discharge unit shown generally by the numeral 30, which comprises an outer support frame 32 and an inner support frame 46 which support an internally positioned discharge hopper 34 having downwardly sloped sides 36 as well as upper vertical sides 38. A sight panel 40 is positioned above a pair of arm holes 42 to permit the operator to see inside the hopper. A pair of gauntlets 44 are fixedly attached to the arm holes 42 for use by the operator in inserting his hands in the gauntlets and reaching inside the hopper to position the lower liner discharge spout 26 and to untie the tying cord 20 on the bag 10 as well as the tying cord 27 on the bag liner without touching the bulk material product 21 inside the bag.

A pair of electro-pneumatic agitators 48 and 50 are fixedly attached to the outer support frame 32 and are used to alternately agitate the bottom of the bulk bag 10 to improve the discharge flow out of the bag 10 as the bag 10 sits on top of the discharge unit 30. A pneumatic cylinder 52 operates the agitator roll 48 while a pneumatic cylinder 54 operates the agitator roll 50.

Figure 6:
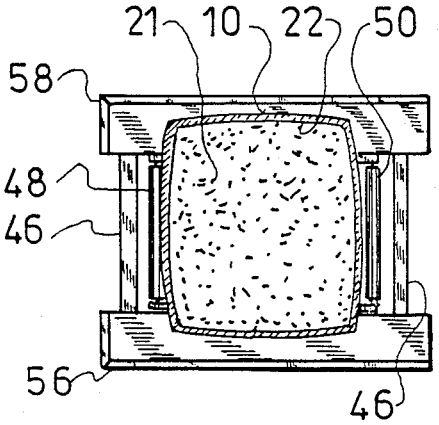
FIG. 6 is a cross-sectional plan view, taken along line 6—6 of FIG. 5.

Upper trays 56 and 58 are fixedly attached to the outer support frame 32 and support the bulk bag 10 whenever it is positioned on the discharge unit as shown in FIGS. 5 and 6. FIG. 6 shows in more detail the positioning of the agitator rolls 48 and 50 in relation to the upper trays 56 and 58. A control box 60 is fixedly attached to the outer support frame 32 and contains the electrical controls for the electro-pneumatic agitators.

Figure 7:
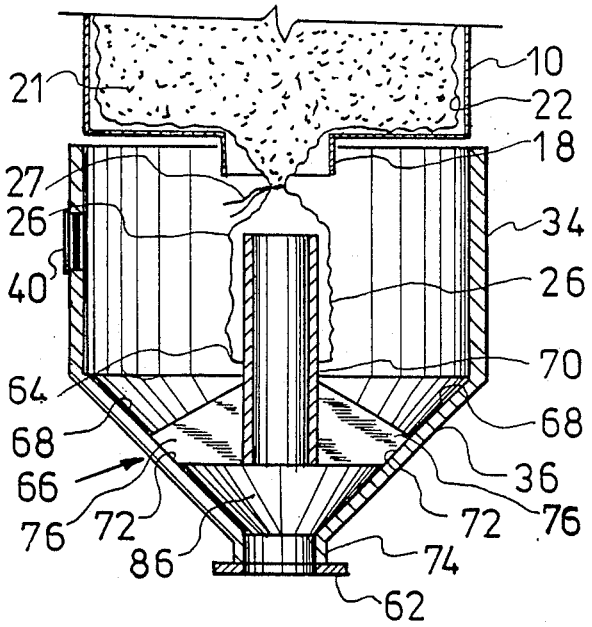
FIG. 7 is a cross-sectional elevational view, taken along line 7—7 of FIG. 5 showing the new and novel inner liner support.

The downwardly sloped sides 36 of the discharge hopper 34 terminate in a bottom cylinder 74 having a flange 62 welded thereto for attachment to a conveyor, auger or a valve as before mentioned. Referring now to FIG. 7 of the drawings, there is shown a cross-sectional elevational view, taken along line 7—7 of FIG. 5 and shows the applicant's new and novel inner liner support 66 which is fixedly attached by welding to the inner sides 68 of the downwardly sloped sides 36 of the discharge hopper 34.

An upwardly extending tube 70, having a plurality of splitter fingers 76, is positioned as shown with the splitter fingers 76 being welded at 72 to the inner sides 68 of the discharge hopper 34. When formed thusly in the preferred embodiment, the inner liner support 66 is in a position, as shown in FIG. 7, to receive the end 64 of the lower liner discharge spout 26 inside the discharge hopper 34. After the lower liner discharge spout 26 has been positioned over the upwardly extending tube 70 by the operator using his arm and hands positioned in the gauntlets 44, the operator is able to untie the tying cord 27 on the lower liner discharge spout 26 to allow the bulk product 21 to discharge out of the bulk bag 10.

Figure 8:
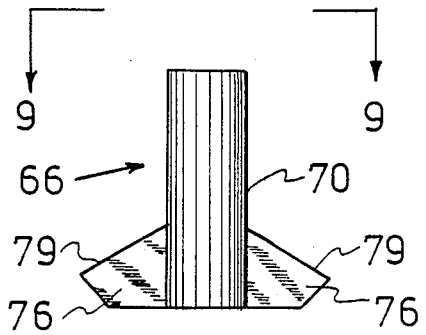
FIG. 8 is a side elevational view of the inner liner support.
Figure 9:
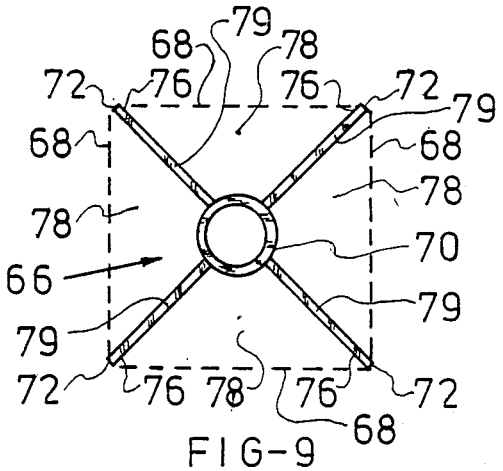
FIG. 9 is a top plan view, taken along line 9—9 of FIG. 8, showing in detail the splitter fingers forming the plurality of openings through which bulk product will pass.

Since the diameter of the lower liner discharge spout 26 is larger than the diameter of the upwardly extending tube 70, upon untying of the tying cord 27, a smaller portion of the bulk product 21 will flow outside of the upwardly extending tube 70 with a major portion of the bulk product flowing inside the tube 70. The splitter fingers 76 form a plurality of openings 78 through which the smaller portion of the bulk product 21 can flow. By referring to FIG. 8 there is shown in detail the construction of the splitter fingers 76 and FIG. 9 shows how the inner liner support 66 would be positioned inside the discharge hopper 34. In FIG. 9, the inner sides 68 of the downwardly sloped sides 36 of the discharge hopper 34 are shown as dashed lines so that the openings 78 can be clearly seen. It can also be seen in FIG. 9 how the splitter fingers 76 would form a bridge to prevent the excess bag liner 22 and lower liner discharge spout 26 from passing beyond the upper sides 79 of the splitter fingers 76.

Figure 10:
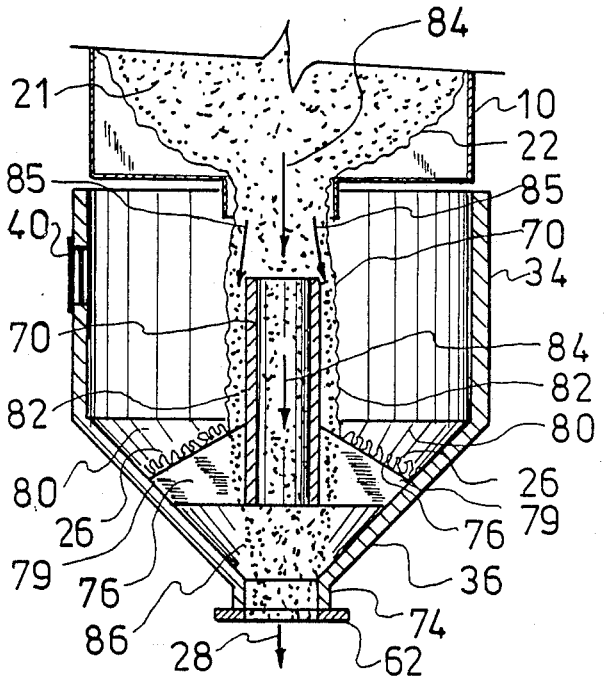
FIG. 10 is a cross-sectional elevational view similar to the view of FIG. 7 showing a bulk bag being emptied and showing how the excess liner builds up in the reservoir means or area between the hopper sides and the upwardly extending tube.

The position of the upwardly extending tube 70 inside the hopper and the position of the splitter fingers 76 form a reservoir means 80 shown in FIG. 10 for receipt and storage of the excess bag liner 2 and lower liner discharge spout 26. FIG. 10 shows a cross-sectional elevational view, similar to the view of FIG. 7, where there can be seen an opened bulk bag 10 with bulk product 21 flowing downwardly in the direction shown by the arrow 84. As has been before mentioned, a smaller portion of the bulk product 21 will flow on the outside of the upwardly extending tube 70 in the direction shown by the arrow 85 in the space 82 between the tube and the liner.

It can be seen then in FIG. 10 how the splitter fingers 76 serve to retain the excess liner on the upper sides 79 of the fingers in the reservoir means 80 to prevent the excess liner from falling into the lower area 86 below the upwardly extending tube 70. As a result the bulk product 21 will pass through and around the tube 70 to flow out of the discharge hopper 34 in the direction of the arrow 28 at the flange 62. Since the splitter fingers 76 hold the excess liner in the reservoir means, the excess liner can not drop into the lower conveyor, auger or valve to interfere in the unloading process. In the preferred embodiment, the splitter fingers 76 function as an inner liner support and also as a support for the upwardly extending tube 70.

Figure 11:
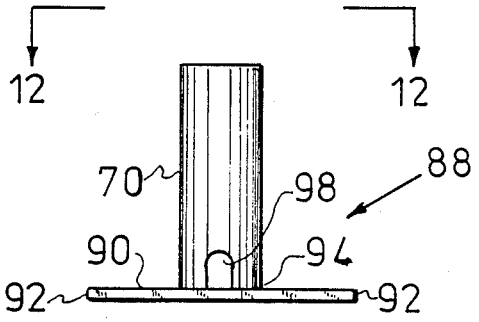
FIG. 11 is a side elevational view of a modification of the inner liner support.
Figure 12:
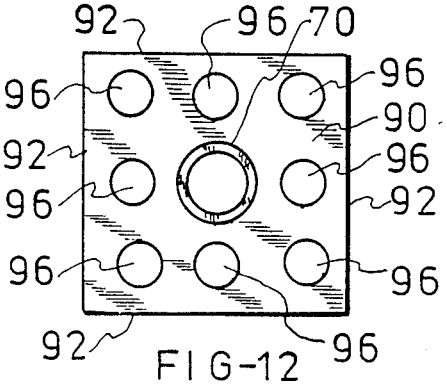
FIG. 12 is a top plan view, taken along line 12—12 of FIG. 11.
Figure 19:
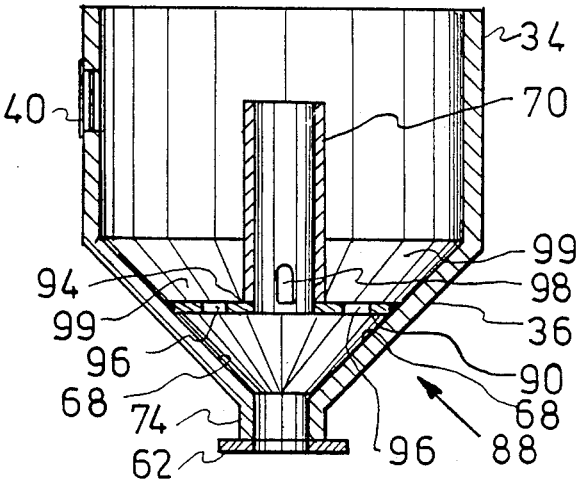
FIG. 19 is a cross-sectional view, similar to the view of FIG. 7, showing how the modification of FIGS. 11 and 12 would be fixedly attached inside the hopper.

Referring now to FIGS. 11, 12 and 19 there is shown a modification of the inner liner support generally by the numeral 88 which comprises a rectangular plate 90 having outer edges 92 which are welded to the inner sides 68 of the downwardly sloped sides 36 of the discharge hopper 34. The mounting of the modified inner liner support 88 in the discharge hopper 34 can be seen in FIG. 19 which is a cross-sectional view similar to the view of FIG. 7. A plurality of holes 96 are formed in the rectangular plate 90 and form the plurality of openings through which bulk product 21 can pass on discharge from the liner 22. Also a plurality of slots 98 are formed in the upwardly extending tube 70 which is also welded at 94 to the rectangular plate 90. The slots 98 also permit bulk product 21 flowing between the lower liner discharge spout 26 and the upwardly extending tube 70 to flow into the tube 70 and out of the discharge hopper 34.

It can be seen also in FIG. 19 how the rectangular plate functions like the slitter fingers 76 of the preferred embodiment to prevent the excess liner from dropping into the lower conveyor, auger or valve. Also the excess liner will lie in the reservoir means 99 formed above the rectangular plate 90 between the upwardly extending tube 70 and the inner sides 68 of the hopper.

Figure 13:
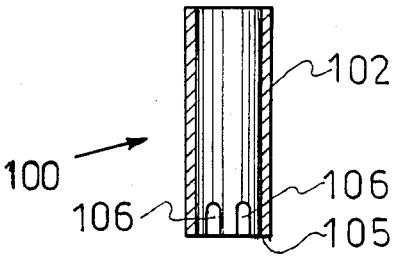
FIG. 13 is a cross-sectional elevational view of another modification of the inner liner support.
Figure 14:
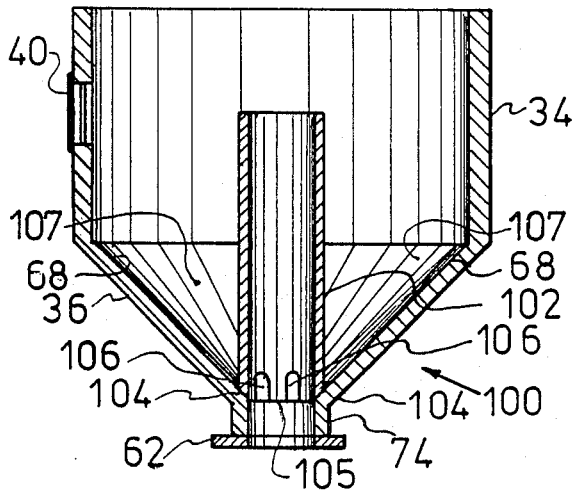
FIG. 14 is a cross-sectional view, similar to the view of FIG. 7, showing how the modification of FIG. 13 would be fixedly attached inside the hopper.

Referring now to FIGS. 13 and 14 of the drawings there will be shown and described another modification of the inner liner support, shown generally by the numeral 100. The modification shown in FIGS. 13 and 14 uses a modified tube 102 which is welded at 104 at the end 105 of the tube to the inner sides 68 of the discharge hopper. A plurality of slots 106 permit bulk product 21 to flow back into the modified tube 102 and out of the hopper. Since the modified tube 102 is welded directly to the hopper sides, the reservoir means 107 serves to retain the excess liner in the reservoir means 107 and the slots 106 form the plurality of openings used to pass bulk product out of the reservoir.

Figure 16:
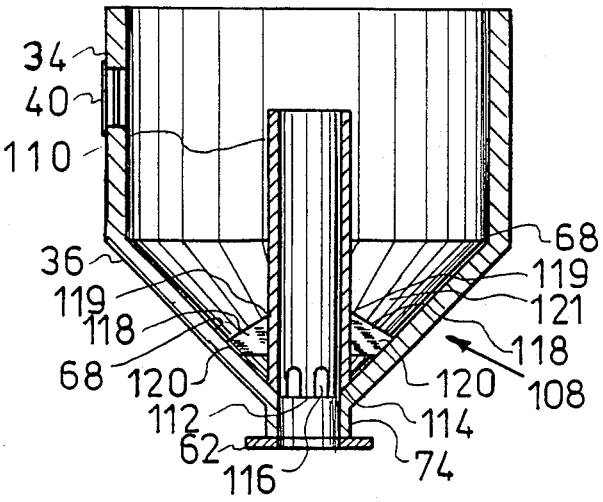
FIG. 16 is a cross-sectional view similar to the view of FIG. 7, showing how the modification of FIG. 15 would be fixedly attached inside the hopper.
Figure 15:
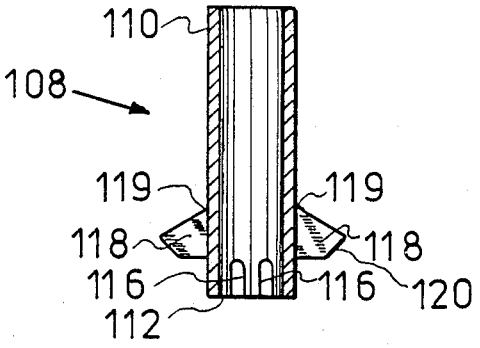
FIG. 15 is a cross-sectional elevational view of still another modification of the inner liner support.

Referring now to FIGS. 15 and 16 there is shown yet another modification of the applicant's novel inner liner support shown generally by the numeral 108 which comprises a generally larger upwardly extending tube 110 having a plurality of slots 116 formed in proximity to the end 112 of the tube. A plurality of modified splitter fingers 118 are welded to the tube at 119 and are also welded at 120 to the inner sides 68 of the hopper. The end 112 of the modified tube 110 is also welded at 114 to the bottom of the hopper in proximity to the bottom cylinder 74. When formed thusly the reservoir means 121 serves to retain the excess liner inside the hopper and the modified splitter fingers hold the liner in the reservoir.

Figure 17:
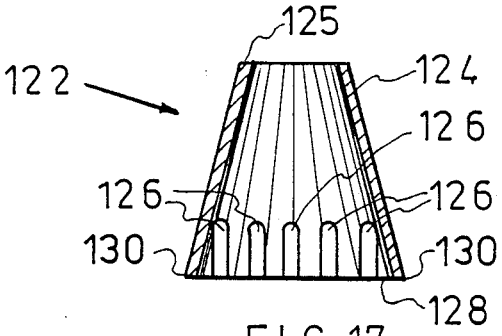
FIG. 17 is a cross-sectional elevational view of yet another modification of the inner liner support.
Figure 18:
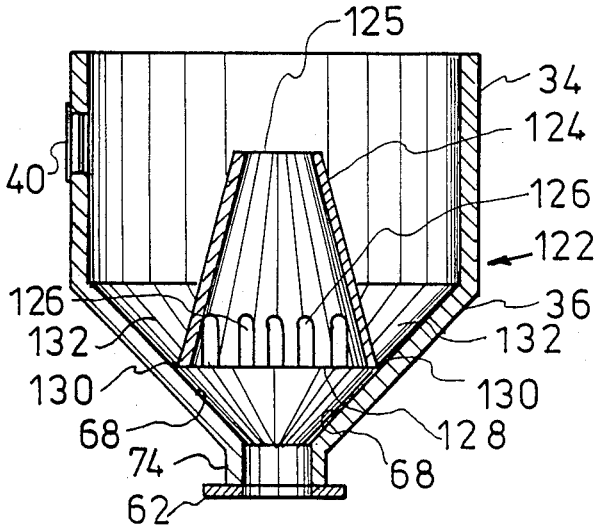
FIG. 18 is a cross-sectional view, similar to the view of FIG. 7, showing how the modification of FIG. 17 would be fixedly attached inside the hopper.

Referring now to FIGS. 17 and 18 there is shown still another modification of the applicant's inner liner support shown generally by the numeral 122 which comprises a modified upwardly extending tube 124 which is formed in a conical shape having a smaller upper end 125 and a larger lower end 128. A plurality of slots 126 are formed in the modified liner support 122 and serve to permit bulk product 21 to pass back into the inside of the modified tube 124. In FIG. 18, there is shown a cross-sectional view similar to the view of FIG. 7 and the modified tube 124 is welded at 130 to the inner sides 68 of the hopper to form the reservoir means 132 to retain and hold the excess liner from dropping into the lower conveyor, auger or valve in proximity to the flange 62. The slots 126 are formed around the circumference of the lower larger end 128 of the conical shaped tube 124.

While there have been shown a preferred embodiment for the inner liner support and several variations thereof, it is within the spirit and scope of the applicant's invention that other variations are possible which have attaching means to attach the inner liner support tube to the inside of the discharge hopper to form the reservoir means to retain the excess bag liner inside the hopper. Other variations would also have formed therein a plurality of openings to permit bulk product, that flows on the outside of the tube, to flow back into the tube and out of the hopper to be discharged.

In the method disclosed herein of preventing the inner liner and inner liner discharge spout of a filled bag from dropping out of a discharge hopper, there would be provided an inner liner support of one of the types herein described. The inner liner support would then be fixedly attached to the inside of the discharge hopper. The filled bulk bag would then be positioned over the discharge hopper and the bag would be opened by untying the bag tying cord. Thereafter the inner liner discharge spout would be pulled out of the lower bag discharge spout.

Since the bag liner is generally formed with a sealed lower inner liner discharge tube end, this end would then be cut by the operator and would then be positioned over the upwardly extending tube of the inner liner support using the gauntlets and the sight panel. Thereafter the liner would be opened by untying the lower liner spout tying cord to allow bulk product to flow into the hopper through the inside of the open upwardly extending tube and also around the outside of the upwardly extending tube between the tube and the liner spout.

The plurality of openings formed in the inner liner support permit bulk product to flow unrestricted while the novel construction of the liner support functions to prevent the liner from dropping into lower mechanisms and causing trouble in the discharge process since the liner is held in the reservoir means by the novel construction of the inner liner support.

By turning on the agitators positioned in proximity to the bottom of the bag, the bag can be agitated alternately on the bottom to aid in discharge of bulk product from the bag and into the hopper. Thereafter the empty bag may be removed from the discharge hopper by lifting the bag and the inner liner upwardly. The excess liner will then lift out of the reservoir means and the outer bag can be recycled by inserting a new inner liner in the bag before filling the bag a second time.

From the foregoing it can be seen that there has been provided by the subject invention a new and novel bulk bag discharge unit and method having a novel bulk bag discharge hopper with a novel inner liner support. The applicant's novel invention in its preferred form and various modified forms functions to accomplish all of the objects and advantages of the invention. It should be noted that other modifications of the basic invention are within the spirit and scope of the applicant's invention and the applicant is not to be limited to the exact embodiment and modifications shown and described which have been given by way of illustration only.

Having described my invention, I claim:

1. A bulk bag dischage hopper having an upper and lower end, the hopper being designed to receive a bulk bag filled with a bulk product, the bulk bag having formed thereon a lower outer bag discharge spout with an inner bag liner being positioned therein, the inner bag liner having a lower liner discharge spout, comprising:

(a) a discharge hopper having downwardly sloped outer and inner sides terminating at a lower end;

(b) an inner liner support, fixedly attached to the downwardly sloped inner sides of the dischage hopper, the inner liner support having fixedly attached thereto an upwardly extending means having a bottom area and top area, the means being for receiving the inner bag liner spout around the outer surface of the upwardly extending means;

(c) a plurality of openings formed in predetermined positions in the inner liner support, the openings serving to permit the bulk product to pass through the inner liner support and to the lower end of the hopper; and (d) reservoir means, formed between the inner liner support and the inner sides of the discharge hopper for receipt and storage of the inner bag liner and lower liner discharge spout whenever the bulk bag is emptied through the bulk bag discharge spout and the inner liner discharge spout and into the lower end of the hopper, the inner liner support also serving to retain a portion of the inner bag liner and the lower liner discharge spout in the reservoir means as the bulk bag is emptied so that the liner and lower liner discharge spout will not pass into the lower end of the hopper.

2. The discharge hopper as defined in claim 1 further comprising the inner liner support being formed with a plurality of outwardly extending splitter fingers positioned around the upwardly extending means, the splitter fingers being fixedly attached to the inner sides of the hopper and forming the plurality of openings.

3. The discharge hopper as defined in claim 1 further comprising the inner liner support being formed with a generally horizontal bottom plate fixedly attached to the bottom of the upwardly extending means and having a central hole positioned therein to allow a portion of the bulk product to pass through the upwardly extending means.

4. The discharge hopper as defined in claim 1 further comprising the upwardly extending means being fixedly attached at the bottom thereof to the inner sides of the hopper, and further comprising the plurality of openings being formed around the upwardly extending means in the proximity of the bottom area of the upwardly extending means.

5. The discharge hopper as defined in claim 1 further comprising the upwardly extending means being formed in a conical shape having a smaller upper end and a larger lower end with the lower end of the upwardly extending means being fixedly attached to the inner sides of the hopper, the larger lower end of the upwardly extending means having formed therein the plurality of openings.

6. A bulk bag discharge unit having a discharge hopper with upper and lower ends, the unit being designed to receive a bulk bag filled with a bulk product, the bulk bag having formed thereon a lower outer bag discharge spout with an inner bag liner being positioned therein, the inner bag liner having a lower liner discharge spout, comprising:

(a) an outer support frame having an upper end;

(b) a discharge hopper, fixedly attached to the support frame and positioned inside the support frame, the hopper having downwardly sloped inner sides terminating at a lower end;

(c) an inner liner support, fixedly attached to the downwardly sloped inner sides of the discharge hopper, the inner liner support having fixedly attached thereto an upwardly extending tube having a bottom area and top area, the tube being for receiving the inner bag liner spout around the outer surface of the upwardly extending tube;

(d) a plurality of openings formed in predetermined positions in the inner liner support, the openings serving to permit the bulk product to pass through the inner liner support and to the lower end of the hopper; and (e) reservoir means, formed between the inner liner support and the inner sides of the discharge hopper for receipt and storage of the inner bag liner and lower liner discharge spout whenever the bulk bag is emptied through the bulk bag discharge spout and the inner liner discharge spout into the lower end of the hopper, the inner liner support also serving to retain a portion of the inner bag liner and the lower liner discharge spout in the reservoir means as the bulk bag is emptied so that the inner bag liner and lower liner discharge spout will not pass into the lower end of the hopper.

7. The discharge unit as defined in claim 6 further comprising at least one bag agitator being fixedly attached to the outer support frame upper end and being positioned to agitate the bulk bag as it is being emptied to aid the bulk product in flowing easily out of the bulk bag and into the discharge hopper.

8. The discharge unit as defined in claim 7 wherein said at least one bag agitator comprises a pair of bag agitators fixedly attached to the outer support frame upper end.

9. The discharge unit as defined in claim 8 further comprising means to operate the pair of bag agitators alternately to agitate the bag.

10. The discharge unit as defined in claim 9 wherein the pair of agitators are electro-pneumatic.

11. The discharge unit as defined in claim 6 further comprising the discharge hopper having formed on the top of the downwardly sloped inner sides, a plurality of upper generally vertical sides having formed therein a sight panel and a pair of arm holes with gauntlets to permit an operator to open the bottom of the bulk bag without contacting the bulk product.

12. A liner support for use in a bulk bag discharge unit having a discharge hopper designed to receive a bulk bag filled with a bulk product, the bulk bag having formed thereon a lower outer bag discharge spout with an inner bag liner having a lower liner discharge spout, comprising:

(a) an upwardly extending tube having an open bottom and an open top, the tube being sized smaller than the bag discharge spout and the liner discharge spout to receive the liner discharge spout;

(b) attaching means, associated with the upwardly extending tube and fixedly attached thereto, for attaching the tube to the inside of the discharge hopper; and (c) a plurality of openings, formed in the liner support to allow the bulk product to pass through the liner support when emptying the bag whenever the liner support is attached to the discharge hopper and the hopper is used in the bulk bag discharge unit.

13. The liner support as defined in claim 12 further comprising the attaching means comprising a plurality of outwardly extending splitter fingers positioned around the upwardly extending tube, the splitter fingers forming the plurality of openings.

14. The liner support as defined in claim 12 further comprising the attaching means comprising a generally horizontal bottom plate fixedly attached to the open bottom of the tube and having a central hole positioned therein to allow a portion of the bulk product to pass through the tube.

15. The liner support as defined in claim 12 further comprising the tube being fixedly attached at the open bottom thereof by weld means which form the attaching means and further comprising the plurality of openings being formed around the tube in the proximity of the open bottom.

16. The liner support as defined in claim 12 further comprising the tube being formed in a conical shape having a smaller upper open end and a larger lower open end, the larger lower end of the conical shaped tube having formed therein the plurality of openings.

17. The liner support as defined in claim 16 wherein the larger lower open end of the conical shaped tube has formed thereon weld means which form the attaching means.

18. In a bulk bag discharge unit of the type wherein a frame mounted hopper is used to funnel bulk product contained in a bulk bag to in-plant sources, the bulk bag being the type having an inner liner contained in an outer bag with both the liner and bag having lower discharge spouts, the improvement comprising an inner liner support being positioned in the hopper and being fixedly attached thereto, the inner liner support having fixedly attached thereto an upwardly extending open-ended means for receiving the liner discharge spout around the means, the inner liner support functioning to bridge the space between the means and the hopper to thereby prevent the bag inner liner from passing beyond the means whenever the bulk bag is emptied.

19. A method of preventing the inner liner and inner liner discharge spout of a filled bulk bag, having a lower discharge spout, from dropping out of a discharge hopper when emptying the bulk bag by opening the bag and liner spout tying cords, comprising:

(a) providing an inner liner support for positioning inside the discharge hopper, the inner liner support having attached thereto an upwardly extending open-ended tube and having formed thereon a plurality of openings to permit bulk product to pass through the openings;

(b) fixedly attaching the inner liner support inside the discharge hopper to thereby provide a reservoir means between the tube and the inside of the hopper for the bag inner liner and liner spout as the bag is emptied;

(c) positioning the filled bulk bag over the discharge hopper;

(d) opening the lower bag discharge spout by untying the bag tying cord;

(e) pulling the inner liner discharge spout out of the lower bag discharge spout;

(f) cutting the lower end of the inner liner discharge spout;

(g) positioning the cut lower end of the inner liner discharge spout over the upwardly extending tube; and (h) opening, by untying the liner spout tying cord, the inner liner discharge spout to allow the bulk product to flow into the hopper with the inner liner support serving to hold the inner liner discharge spout and a portion of the inner liner in the reservoir means and to prevent their passage beyond the upwardly extending tube and out of the reservoir means.

20. The method as defined in claim 19 further comprising the step of:

(i) removing the empty bulk bag from the discharge hopper and removing the inner liner spout and a portion of the inner liner from the reservoir means.

* * * * *